US007094337B2

(12) United States Patent
Williams et al.

(10) Patent No.: US 7,094,337 B2
(45) Date of Patent: Aug. 22, 2006

(54) OVERFLOW CHAMBER

(75) Inventors: Christopher A. Williams, North Somerset (GB); Paul Lecornu, Somerset (GB); Mark D. James, London (GB); Robert Y. G. Andoh, Surrey (GB); Michael G Faram, Bristol (GB)

(73) Assignee: Hydro International PLC, Clevedon (GB)

( * ) Notice: Subject to any disclaimer, the term of this patent is extended or adjusted under 35 U.S.C. 154(b) by 103 days.

(21) Appl. No.: 10/492,410

(22) PCT Filed: Oct. 8, 2002

(86) PCT No.: PCT/GB02/04552

§ 371 (c)(1),
(2), (4) Date: Oct. 29, 2004

(87) PCT Pub. No.: WO03/031738

PCT Pub. Date: Apr. 17, 2003

(65) Prior Publication Data

US 2005/0045541 A1 Mar. 3, 2005

(30) Foreign Application Priority Data

Oct. 10, 2001 (GB) ..... 0124326.0

(51) Int. Cl.
*E03F 5/14* (2006.01)

(52) U.S. Cl. ..... 210/162; 210/306; 210/312; 210/433.1; 210/532.1; 405/80

(58) Field of Classification Search ..... 210/154, 210/162, 254, 299, 305, 306, 312, 521, 433.1, 210/532.1; 405/80, 52
See application file for complete search history.

(56) References Cited

U.S. PATENT DOCUMENTS

| | | | | |
|---|---|---|---|---|
| 419,887 | A * | 1/1890 | Robinson | 210/162 |
| 454,185 | A * | 6/1891 | Robinson | 210/162 |
| 2,463,814 | A * | 3/1949 | Skinner | 210/433.1 |
| 4,578,188 | A * | 3/1986 | Cousino | 210/532.1 |
| 5,433,845 | A * | 7/1995 | Greene et al. | 210/305 |
| 5,531,888 | A * | 7/1996 | Geiger et al. | 210/433.1 |
| 5,770,057 | A * | 6/1998 | Filion | 210/162 |
| 5,779,888 | A * | 7/1998 | Bennett | 210/162 |
| 5,814,216 | A * | 9/1998 | Filion | 210/306 |
| 6,132,626 | A * | 10/2000 | Hart | 210/162 |
| 6,428,692 | B1 * | 8/2002 | Happel | 210/305 |

FOREIGN PATENT DOCUMENTS

| | | |
|---|---|---|
| GB | 487803 | 6/1938 |
| GB | 1 530 045 | 10/1978 |
| GB | 2 293 993 | 4/1996 |
| GB | 2 372 715 | 9/2002 |

* cited by examiner

*Primary Examiner*—Christopher Upton
(74) *Attorney, Agent, or Firm*—Douglas E. Jackson; Stites & Harbison PLLC

(57) ABSTRACT

An overflow chamber (2) is provided for use in a combined sewer overflow. An inlet (12) and an outlet (14) open into the chamber (2) below a screen (20), and an overflow outlet (15) opens into the chamber above the screen. Baffles (26) are provided underneath the screen (20) across the general flow of storm water. In storm conditions, the storm water in the chamber (2) will reach the level of the screen (20), which traps aesthetically offensive material and gross solids, leaving the water to flow through the screen (20) to the overflow outlet (15). The baffles (26) circulate the storm water, and this dislodges material accumulated on the underside of the screen (20) and so helps to prevent blinding of the screen (20) in storm conditions.

8 Claims, 1 Drawing Sheet

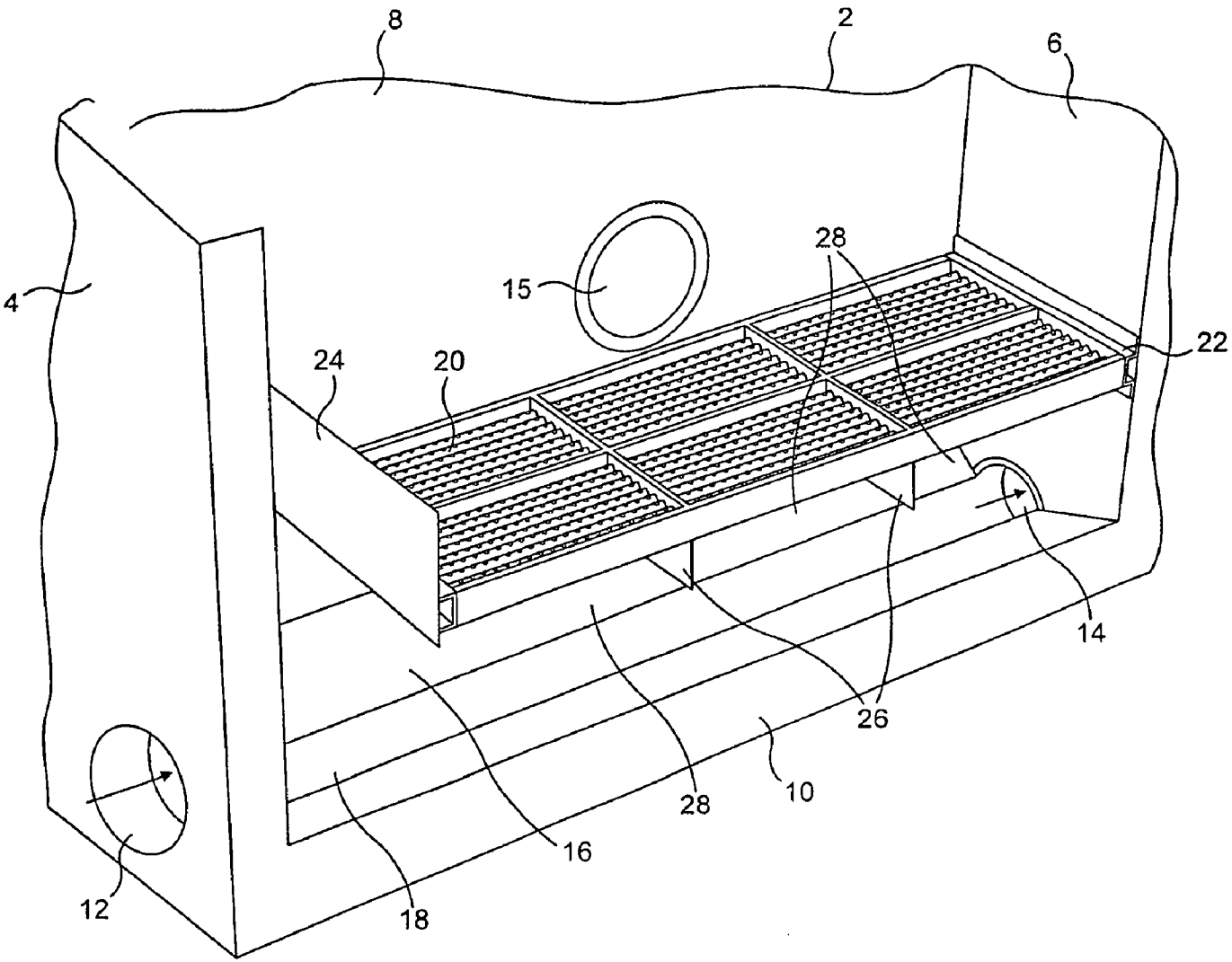
22
6
14
2
28
26
10
28
15
16
20
8
18
24
12
4

OVERFLOW CHAMBER

This invention relates to an overflow chamber and is particularly, although not exclusively, concerned with an overflow chamber for use in a combined sewer overflow (CSO). The present invention is also concerned with a screen for use in such an overflow chamber.

CSOs are known which comprise a chamber divided horizontally by a screen. An inlet and an outlet open into the chamber below the screen, and an overflow outlet opens into the chamber above the screen. The inlet is of larger diameter than the outlet. In normal operation, sewage and rain water flow into the chamber through the inlet at a relatively low flow rate, and pass through the outlet to the sewage system.

In storm conditions, the flow of storm water through the inlet is greater than the outlet will accept. Consequently, water and sewage builds up within the chamber. Eventually, the storm water in the chamber will reach the level of the screen, which traps aesthetically offensive material and gross solids, leaving the water to flow through the screen to the overflow outlet. As the storm recedes, and the water level in the chamber drops below the screen, solids accumulated on the screen fall away and pass with the remaining water to the sewage system through the outlet.

A problem with such screens is that solids may accumulate on the screen under storm conditions, so that it is wholly or partially "blinded" and the ability of water to flow through the screen is reduced. Under such circumstances, water, with entrained gross solids, may flow through an emergency bypass to a watercourse.

According to the present invention there is provided an overflow chamber comprising an inlet and an outlet, a screen disposed above the inlet and outlet whereby flow may take place between the inlet and the outlet without passing through the screen, and an overflow outlet disposed above the screen, at least one baffle being provided in the chamber below the screen, the baffle extending across the general flow direction between the inlet and the outlet.

The effect of the baffle is to create, within the chamber below the screen, a series of compartments within which storm water circulates in such a manner as to sweep the underside of the screen, thereby to dislodge material accumulated on the screen.

There may be at least two of the baffles, and they may be fixed to the screen and project downwardly from it. They preferably stop short of the floor of the chamber, and may, for example, have a vertical extent which is approximately three times the vertical depth of the screen.

The inlet and the outlet may open into the chamber opposite each other, and the flow cross-section of the outlet is preferably smaller than the flow cross-section of the inlet.

For a better understanding of the present invention and to show how it may be carried into effect reference will now be made, by way of example, to the accompanying FIGURE, which shows a combined sewer overflow.

The overflow shown in the FIGURE comprises a chamber 2 of generally rectangular shape, as seen in plan view, comprising end walls 4 and 6 and side walls 8 and 10. An inlet 12 is provided in the end wall 4, and an outlet 14 is provided in the end wall 6. The inlet 12 and the outlet 14 are generally opposite one another, although the outlet 14 is at a slightly lower level than the inlet 12. The floor 16 of the chamber 2 has a gully 18 which channels sewage under low-flow conditions between the inlet 12 and the outlet 14.

A screen 20 is provided in the chamber 2. It is generally horizontal, and may, for example, comprise a corrugated apertured panel which may be provided with a non-stick plastic coating. By way of example, the apertures in the screen may have a diameter (or equivalent transverse dimension) of 4 mm.

As shown in the FIGURE, the screen 20 has a frame 22 which is secured to at least some of the walls 4, 6, 8, 10 of the chamber 2. The screen 20 stops short of the end wall 4, and is provided at that end with a weir plate 24. Baffles 26 are provided on the underside of the screen 20, and extend substantially the full width of the screen 20. The baffles 26 are disposed vertically, and stop short of the floor 16 of the chamber 2. Two of the baffles 26 are provided, disposed at approximately equal intervals along the length of the screen 20. It will be appreciated that the baffles 26 divide the region of the chamber 2 beneath the screen 20 into three compartments 28 of substantially equal length, which compartments are intercommunicate with one another through the gaps left between the lower edges of the baffles 26 and the floor 16.

The chamber is installed in a sewage system, so that the inlet 12 is connected to receive sewage and rain water, and the outlet is connected to downstream components of the sewage system. An overflow outlet 15 is connected, for example, for discharge into a river or other watercourse.

Under normal flow conditions, sewage and other water, for example light rainfall, entering the system will pass through the inlet 12 and flow along the gully 18 to the outlet 14. Under heavier flow, for example under storm conditions, the smaller flow cross-section of the outlet 14 will not be able to accept the full incoming flow through the inlet 12, and consequently the water level in the chamber 2 will rise. As it rises, it carries with it entrained aesthetically offensive material and gross solids. Eventually, the level will reach the screen 20, which will have the effect of intercepting the solids material allowing only the water to reach the overflow outlet 15 and the watercourse into which it discharges.

Under these heavy flow conditions, the flow pattern within the chamber 2 below the screen 20 is modified by the baffles 26. Thus, as seen in vertical cross-section, flow striking each baffle (and the end wall 6) will be deflected upwards and will undergo a swirling motion about a horizontal axis extending transversely across the chamber between the walls 8 and 10. Consequently, a reverse flow (with respect to the normal direction of flow between the inlet 12 and the outlet 14) will occur across the underside of the screen 20, re-entraining much of the material deposited on the screen 20. Consequently, any blockage of the apertures in the screen 20 is minimised, so that flow through the screen 20 can take place even when the flow entering through the inlet 12 is heavily contaminated by solids material. Nevertheless, should exceedingly high flow rates occur, and, despite the flushing action of the circulating flow in the compartments 28, the screen becomes substantially blinded, the weir plate 24 provides an emergency overflow allowing full flow through the inlet 12 to overflow the weir plate 24 and reach the overflow outlet 15 without passing through the screen 20.

As the storm subsides, the inflow through the inlet 12 will reduce, allowing the level in the chamber 2 to fall as the storm water and entrained solids material leave through the outlet 14. As a result of the circulating motion within the compartments 28 and the resulting reduction in settling of solids on the underside of the screen 20, most of the solids materials within the chamber 2 will be able to leave through the outlet 14, leaving the screen 20 relatively unobstructed and able to operate effectively under subsequent storm conditions.

In the FIGURE, the baffles 26 are shown as flat, rectangular plates, although differently shaped plates may be suitable for enhancing the swirl effect generated by them. Also, it will be appreciated that the number and dimensions of the plates 26 may be varied to suit the conditions prevailing in any particular CSO.

The invention therefore provides effective screening in storm conditions to intercept and retain aesthetically offensive material and gross solids so that they do not reach watercourses under overflow conditions. The baffles 26 enhance flow circulation patterns within the chamber 2 to reduce the blinding effect of entrained solids when the screen is in operation.

It will be appreciated that, although the invention has been described with reference to a combined sewer overflow, it may be applied to screens used in other applications.

The invention claimed is:

1. An overflow chamber comprising an inlet and an outlet, a screen disposed above the inlet and outlet, whereby flow may take place between the inlet and the outlet without passing through the screen, and an overflow outlet disposed above the screen, at least one baffle being provided in the chamber below the screen, the baffle extending across the general flow direction between the inlet and the outlet.

2. An overflow chamber as claimed in claim 1, wherein the baffle is one of at least two baffles.

3. An overflow chamber as claimed in claim 1, wherein the or each baffle is fixed to the screen and projects downwardly from the screen.

4. An overflow chamber as claimed in claim 1, wherein the or each baffle stops short of the floor of the chamber.

5. An overflow chamber as claimed in claim 4, wherein the or each baffle has a vertical extent which is approximately three times the vertical depth of the screen.

6. An overflow chamber as claimed in claim 1, wherein the or each baffle comprises a flat rectangular plate.

7. An overflow chamber as claimed in claim 1, wherein the inlet and the outlet are disposed on opposite sides of the chamber.

8. An overflow chamber as claimed in claim 1, wherein the flow cross-section of the outlet is smaller than the flow cross-section of the inlet.

* * * * *